US005377381A

United States Patent [19]

Wilson

[11] Patent Number: 5,377,381

[45] Date of Patent: Jan. 3, 1995

[54] CLEANING SYSTEM AND METHOD

[76] Inventor: Edward G. Wilson, Rte. 2, Box 235B, Lynville, Tenn. 38472

[21] Appl. No.: 966,359

[22] Filed: Oct. 26, 1992

[51] Int. Cl.[6] ..... B08B 9/04; B05C 7/08

[52] U.S. Cl. ..... 15/304; 15/406; 15/104.09

[58] Field of Search ..... 15/304, 406, 345, 302, 15/104.05, 104.09, 104.12, 104.13, 104.14, 104.061, 308, 309, 309.1; 134/167 C, 168 C

[56] References Cited

U.S. PATENT DOCUMENTS

| | | | |
|---|---|---|---|
| 3,074,098 | 1/1963 | Downing | 15/406 |
| 3,106,491 | 10/1963 | Leibner | 15/406 |
| 3,267,504 | 8/1966 | Cook et al. | 134/167 C |
| 4,249,475 | 2/1981 | Lindsey | 15/104.061 |
| 4,418,437 | 12/1983 | French | 15/104.09 |
| 4,763,376 | 8/1988 | Spurlock, Jr. et al. | 134/167 C |
| 5,020,188 | 6/1991 | Walton | 15/304 |
| 5,072,487 | 12/1991 | Walton | 15/304 |

*Primary Examiner*—David A. Scherbel
*Assistant Examiner*—Patrick F. Brinson
*Attorney, Agent, or Firm*—Shook, Hardy & Bacon

[57] ABSTRACT

A cleaning system includes a vehicle with a drive subsystem comprising a fluid-powered drive motor drivingly connected to a pair of drive wheels. A brush/air jet boom assembly is removably mounted on the vehicle and includes a fluid-powered brush subassembly drivingly connected to a brush including a plurality of radially-extending flexible line segments. The brush/air jet boom assembly also includes an air jet subassembly with inboard and outboard nozzles. A spray boom assembly is mountable on the vehicle interchangeably with the brush/air jet boom assembly and includes a spray head for spraying a liquid spray material. A cleaning method includes the steps of providing compressed air and liquid spray material sources; pneumatically coupling a vehicle to the compressed air source; advancing the vehicle by pneumatically driving drive wheels thereof; pneumatically driving a rotating brush subassembly; brushing an object to be cleaned; pneumatically sweeping the object to be cleaned; interchanging a spray boom assembly with a brush/air jet assembly; coupling the spray boom assembly to the compressed air and liquid spray material sources; and pneumatically spraying the liquid spray material on the object to be cleaned.

10 Claims, 3 Drawing Sheets

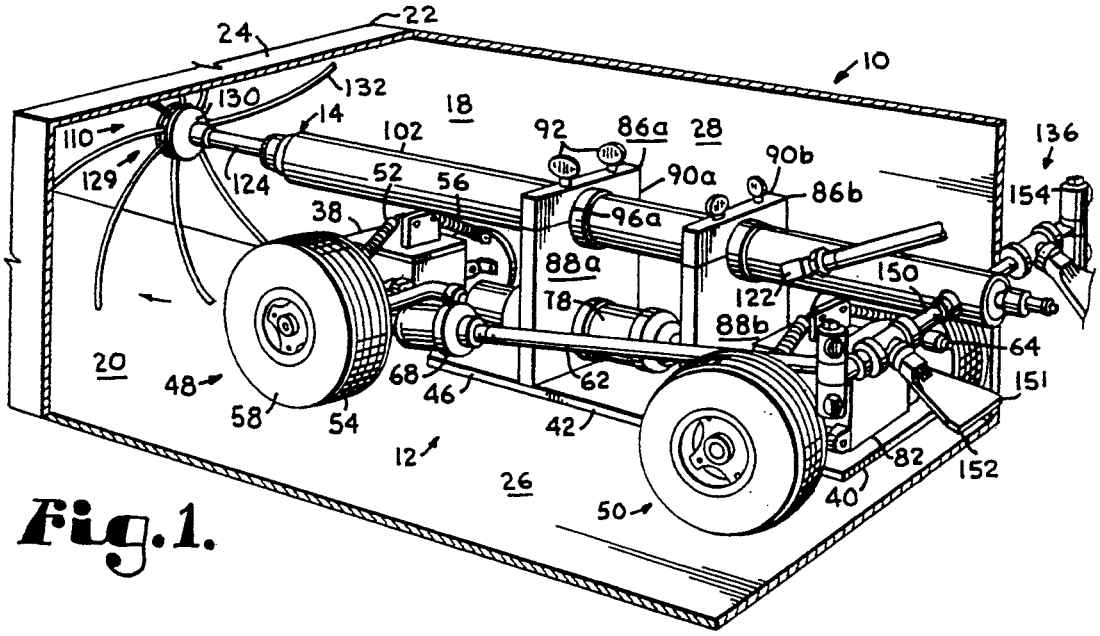
Fig. 1.
Fig. 2.
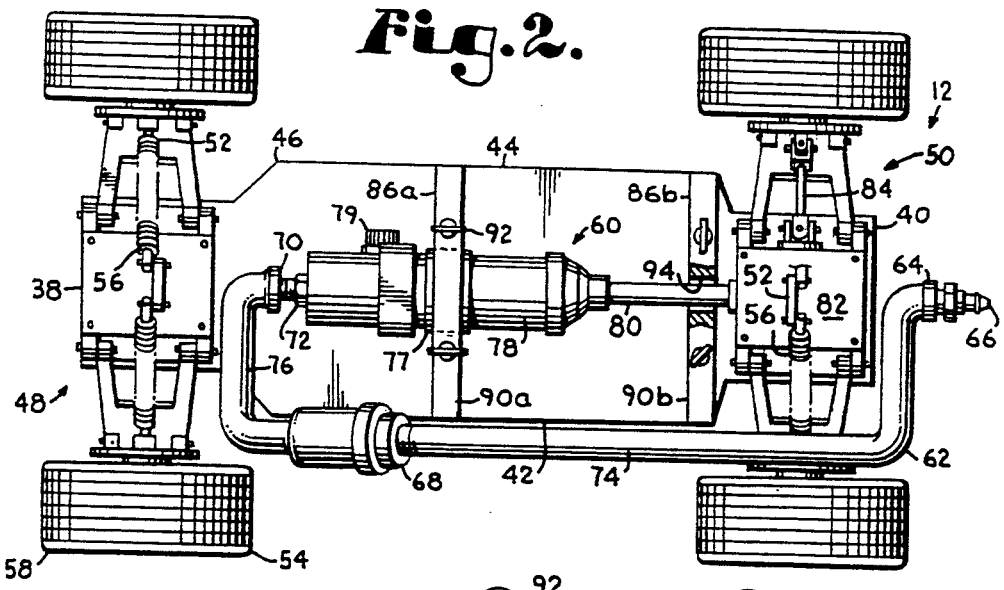
Fig. 3.
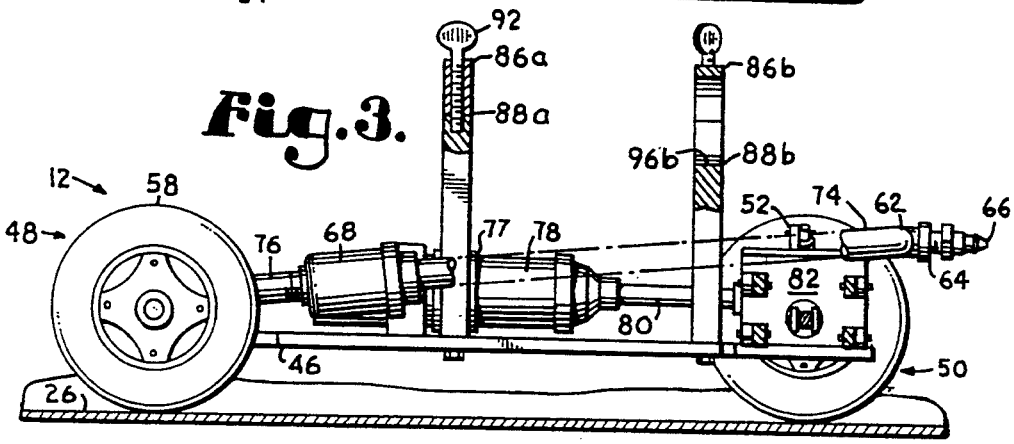

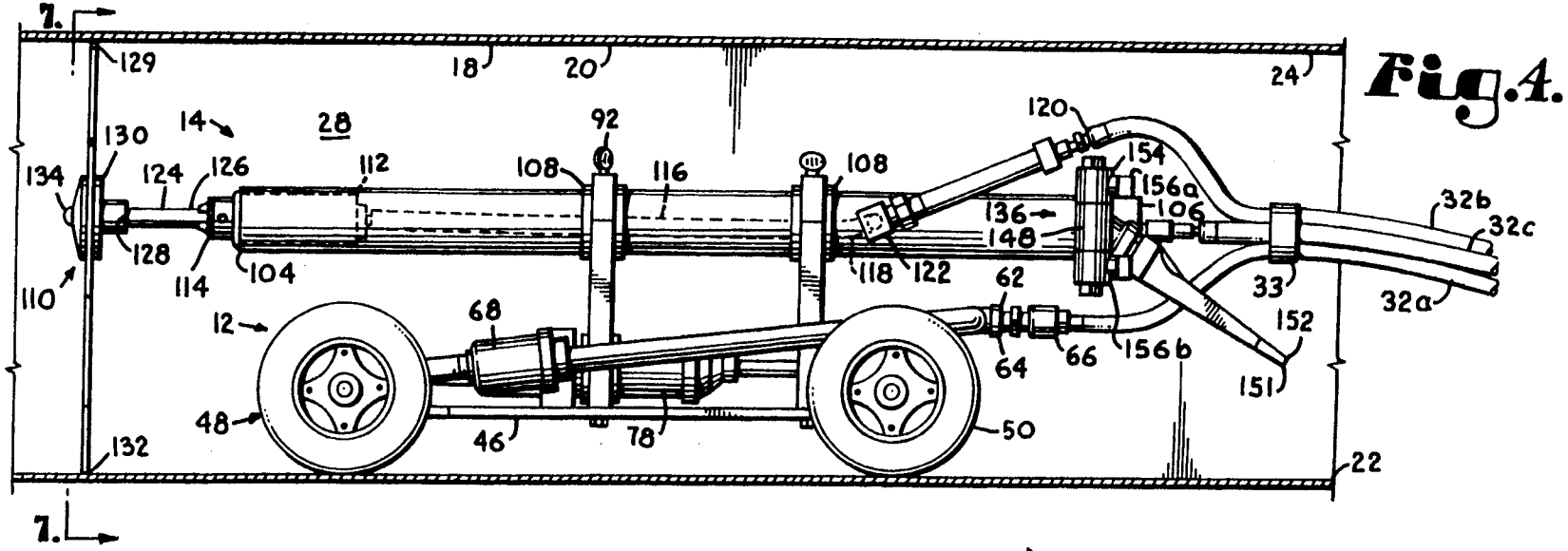
Fig.4.
32c
32b
32a
22
24
33
152
151
156a
106
156b
154
120
136
148
66
62
64
50
122
118
108
116
92
78
20
18
68
46
112
28
104
126
14
114
12
48
124
128
129
130
132
134
110
7.
7.
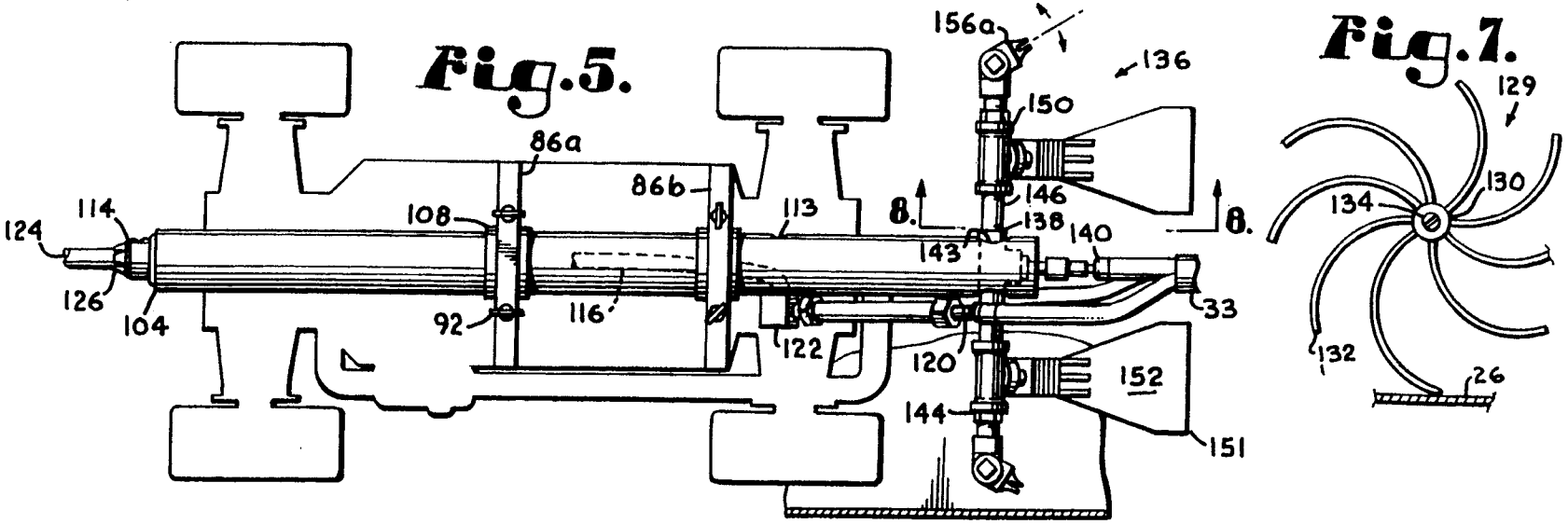
Fig.7.
129
130
26
134
132
Fig.5.
8.
8.
136
33
151
152
150
146
138
140
156a
143
120
144
113
122
86b
116
86a
108
92
104
114
126
124

CLEANING SYSTEM AND METHOD

BACKGROUND OF THE INVENTION

1. Field of the Invention

The present invention relates generally to cleaning systems and in particular to a system and method for cleaning and servicing ducts.

2. Description of the Related Art

Various cleaning devices and systems have heretofore been proposed to meet the requirements of particular cleaning tasks and operations. In addition to hand operated cleaning tools of various sizes and configurations, powered cleaning devices and systems have been designed to reduce the manual labor and time requirements for many cleaning operations, and to improve their thoroughness and efficiency. For example, brushes can be drivingly connected to motors to provide a variety of devices for automated sweeping and brush cleaning functions. Fluid media, such as air and various liquids, can also be used for cleaning. Pneumatic systems are well known and use pressurized or forced air for dislodging dirt, debris and other matter. Power-driven brush and pneumatic cleaning systems can be combined in devices such as vacuum cleaners and sweepers.

Air handling ducts in commercial, institutional and residential structures can pose particular cleaning and maintenance problems. The passages in such ducts often become coated with dust particles and other foreign matter, which can support bacterial and fungal activity. Such biological activity can adversely effect the health of the structure's occupants. Various bacteria, microbes and spores which can cause disease or contribute to allergic reactions can be transmitted by air currents flowing through the ducts.

The buildup of such dirt and debris, which can provide a breeding ground for various microorganisms, can be somewhat controlled by providing the air handling equipment with filters for entrapping particulate matter in the air stream. However, even heating, ventilation and air conditioning (HVAC) systems equipped with air filters are susceptible to the accumulation of dirt and other debris over extended periods of use. Such accumulations present problems associated with exposure to airborne microbes and other problems related to loss of HVAC system efficiency as the duct passages become more and more restricted. In extreme cases the accumulation of dirt and other debris could pose a fire hazard. In addition to air-borne dust particles, various other types of debris and even vermin can collect in the enclosed ductwork. Previous systems and methods for cleaning such duct passage inner surfaces have tended to be time consuming, expensive and/or relatively ineffective. Heretofore there has not been available a cleaning system and method with the advantages and features of the present invention.

SUMMARY OF THE INVENTION

In the practice of the present invention, a cleaning system is provided for cleaning objects such as the inner surfaces of heating, ventilation and air conditioning (HVAC) duct passages. The system includes a vehicle with a non-driven front wheel assembly and a driven rear wheel assembly. A vehicle drive subsystem includes an air motor drivingly connected to a gearbox, which in turn is drivingly connected to the rear wheel assembly. A brush/air jet boom assembly and a spray boom assembly are interchangeably mountable on the vehicle. The brush/air jet boom assembly includes a fluid-powered brush subassembly mounted on a front end thereof and an air jet subassembly mounted on a back end thereof. The vehicle is adapted for connection to a pressurized air source by air hoses for pneumatically powering the vehicle drive motor and a brush air motor. The pressurized air source also communicates compressed air to the air jet subassembly for pneumatically sweeping the object. The spray boom assembly includes a spray head subassembly and is adapted for connection to the pressurized air source and to a liquid spray material source. The spray boom assembly includes a spray nozzle for pneumatically spraying the liquid spray material.

In the practice of the method of the present invention, compressed air and liquid spray material sources are provided and connected to a vehicle by air and spray material hoses. The vehicle is driven by an air motor pneumatically connected to the compressed air source. The inner surfaces of a duct passage can be cleaned by advancing the vehicle into the passage and pneumatically driving a brush subassembly for loosening accumulated dirt and other debris. On a retraction stroke, the duct passage is pneumatically swept by a spray jet subassembly mounted on the vehicle.

After brushing and pneumatically sweeping the duct passage, the spray boom assembly can be substituted on the vehicle for the brush/air jet assembly. The vehicle is then run through the passage and liquid spray material is pneumatically applied to the inner surfaces thereof.

OBJECTS AND ADVANTAGES OF THE INVENTION

The principle objects and advantages of the present invention include: providing a system for cleaning objects; providing such a system which includes a self-propelled vehicle; providing such a system with a compressed air source for pneumatically driving the vehicle; providing such a system with interchangeable brush/air jet and spray boom assemblies; providing such a system wherein the brush/air jet boom assembly includes a fluid-powered brush subassembly; providing such a system wherein the brush/air jet boom assembly includes an air jet subassembly; providing such a system wherein the air jet subassembly includes pivotably adjustable air nozzles; providing such a system wherein the spray boom assembly includes a spray head subassembly; providing such a system wherein the spray head subassembly is adapted for spraying various liquid spray materials, such as disinfectant and sealer: providing such a system which is adapted for operation in ducts with rectangular, circular and other cross-sectional configurations; providing such a system which is economical to manufacture, efficient in operation, capable of a long operating life and particularly well adapted for the proposed usage thereof; providing a cleaning method; providing such a method which includes the steps of brushing the inner surfaces of a duct passage, pneumatically sweeping the duct passage and spraying the duct passage inner surfaces; providing such a method which includes the step of disinfecting the duct passage inner surfaces; and providing such a method which includes the step of sealing the duct passage inner surfaces.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a fragmentary, top, left side, rear perspective view of a cleaning system embodying the present invention, particularly showing a vehicle thereof positioned in a duct.

FIG. 2 is a fragmentary, top plan view of the vehicle, particularly showing a drive subsystem thereof.

FIG. 3 is a fragmentary, left side elevational view of the vehicle, shown without a boom assembly mounted thereon.

FIG. 4 is a left side elevational view of the vehicle with a brush/air jet boom assembly mounted thereon.

FIG. 5 is a top plan view of the vehicle, particularly showing the brush/air jet boom assembly.

FIG. 7 is an enlarged, fragmentary, front elevational view of the brush/air jet boom assembly, particularly showing a brush thereof.

DETAILED DESCRIPTION OF THE PREFERRED EMBODIMENTS

I. Introduction and Environment

Figures 6, 8, 9, 10, 11:
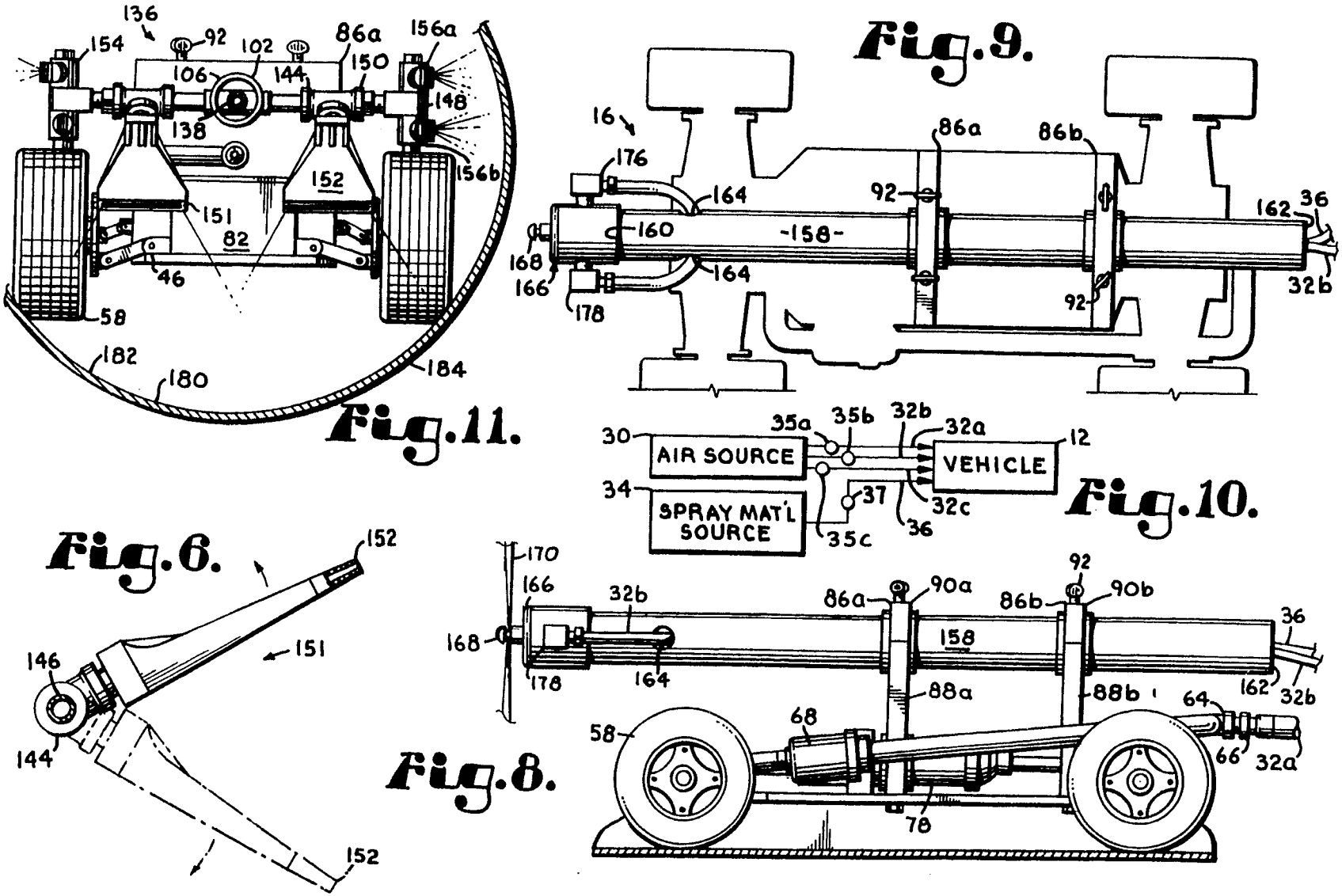
FIG. 6 is an enlarged, fragmentary, side elevational view of the brush/air jet boom assembly, particularly showing inboard nozzle means thereof.
FIG. 8 is a left side elevational view of the vehicle, shown with a spray boom assembly mounted thereon.
FIG. 9 is a top plan view of the vehicle, particularly showing the spray boom assembly.
FIG. 10 is a schematic diagram of the cleaning system.
FIG. 11 is a rear elevational view of the vehicle with the brush/air jet boom assembly mounted thereon, shown in a duct with a round cross-sectional configuration.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, a cleaning system embodying the present invention is generally designated by the reference numeral 10 and generally comprises a fluid-powered vehicle or carrier 12 mounting cleaning means, which can comprise either a brush/air jet boom assembly 14 or a spray boom assembly 16.

Without limitation on the generality of useful applications of the cleaning system 10, it is shown and described in connection with a procedure and method for cleaning the inside surfaces 18 of a passage 20 through a duct 22 of a heating, ventilation and air conditioning (HVAC) system. The duct passage 20 normally conveys a flow of air, and particulate matter entrained in the air stream can accumulate on the duct wall inner surfaces 18. The cleaning system 10 and its method of operation facilitate the removal of such accumulated matter and the sealing of the duct wall inner surfaces 18. The duct 22 shown in FIG. 1 is generally rectangular in cross-section, with a top wall 24, a bottom wall 26 and opposite sidewalls 28. The cleaning system 10 can also service ducts with other cross-sectional configurations, e.g. round (FIG. 11), as will be described in more detail hereinafter.

A pressurized air source 30 can comprise a compressor and can be selectively connected to the vehicle 12 by an appropriate number of air hoses 32*a*, 32*b*, 32*c* (e.g., three are shown) which can comprise a flexible material such as rubber and are secured together by bands 33. The air source 30 can include suitable air valves 35*a*, 35*b*, 35*c* for selectively providing an air flow through the air hoses 32*a*, 32*b*, 32*c* respectively.

A liquid spray material source 34 can be selectively connected to the vehicle 12 by a suitable liquid spray material hose 36 and can communicate various cleaning, disinfecting and sealing solutions to the vehicle 12 for application to the duct passage inner surfaces 18 by means of the spray boom assembly 16, as will be discussed in more detail hereinafter. The liquid source 34 includes a liquid valve 37 for selectively, fluidically connecting the liquid source 34 with the liquid hose 36. The air and liquid sources 30, 34 can be located remotely from the duct 22 being serviced.

II. Vehicle 12

The vehicle 12 has front and back ends 38, 40 and first (left) and second (right) opposite sides 42, 44.

The vehicle 12 includes a chassis 46 which mounts a front wheel assembly 48 with wheels 54 at the vehicle front end 38 and a rear wheel assembly 50 with wheels 54 at the vehicle back end 40. In the illustrated embodiment of the present invention, the wheel assemblies 48, 50 are aligned for generally straight travel by the vehicle 12, but wheel assemblies adapted for turning (e.g., by remote control) could be provided within the scope of the present invention. In the illustrated embodiment of the cleaning system 10 the vehicle 12 is disclosed as having a non-driven front wheel assembly 48 and a driven rear wheel assembly 50, but such characteristics could be reversed or the vehicle 12 provided with four driven wheels.

Independent suspension subassemblies 52 can be provided for each wheel 54, and each can include a suitable spring/shock absorber mechanism 56. Each wheel 54 mounts a tire 58 for tractional guiding and driving engagement with the duct bottom wall 26.

The vehicle 12 is propelled by fluid-powered drive means comprising a drive subsystem 60. The drive subsystem 60 includes a fluid (e.g., air) tube assembly 62 with a proximate inlet end 64 mounting a coupling 66 for releasable connection to the air hose 32*a*, an in-line oiler 68 and a distal outlet end 70 mounting a coupling 72. The air tube assembly 62 can comprise first and second tubing sections 74, 76 which can be bent to run the air tube assembly 62 alongside a first side 42 of the vehicle 12 with both the inlet and outlet ends 64, 70 opening generally rearwardly.

A fluid motor (e.g., air motor) 78 is fluidically coupled to the air tube outlet end 70 and is drivingly connected by means of a drive shaft 80 to a gearbox 82 mounted on the chassis 46 in proximity to the vehicle back end 40. The gearbox 82 is drivingly connected to the wheels 54 of the rear wheel assembly 50 by a pair of drive axles 84. The fluid motor 78 can comprise, for example, a type of air motor which is commonly used in pneumatic screwdrivers, and is preferably chosen for its desired operating characteristics such as size, weight, torque and operating speed. The fluid motor 78 can include a speed control 79, but in normal operation it may be preferable to operate the fluid motor 78 at full speed. The fluid motor 78 can also be reversible, but in normal operation the vehicle 12 is driven under fluid power in a forward direction only and is retrieved by pulling on the hoses 32*a*, 32*b*, 32*c* and 36 connected thereto, as will be described in more detail hereinafter.

The vehicle 12 includes front and back mounting brackets 86*a*, 86*b* with lower sections 88*a*, 88*b* mounted on the chassis 46 and upper sections 90*a*, 90*b* removably secured to the lower sections 88*a*, 88*b* by thumbscrews 92.

The front mounting bracket section 88*a* receives and mounts the fluid motor 78 with an annular, fluid motor gasket 77 therebetween for isolating and dampening vibration from the fluid motor 78. The back mounting bracket lower section 88*b* has an aperture 94 through which the drive shaft 80 rotatably passes. The lower and upper mounting bracket sections 88*a*, 88*b*, 90*a*, 90*b* have respective semi-circular openings which form respective front and back circular boom openings 96*a*, 96*b* when the brackets 86*a*, 86*b* are assembled.

III. Brush/Air Jet Boom Assembly 14

The brush/air jet boom assembly 14 includes a generally cylindrical, hollow, tubular boom 102 with front and back ends 104, 106 which can overhang the vehicle front and back ends 38, 40 (FIGS. 4 and 5). The brush-/air jet boom 102 is removably received in the mounting bracket boom openings 96*a*, 96*b* with a pair of annular boom mounting gaskets 108 encircling the brush/air jet boom 102 and received in the boom openings 96*a*, 96*b*.

The brush/air jet boom 14 includes a brush subassembly 110 comprising a fluid-powered (e.g., air) brush motor 112 mounted in the boom front end and axially drivingly mounting a chuck 114. The brush motor 112 can be connected to the air source 30 by means of a brush motor air tube 116 with an inlet end 118 mounting a hose coupling 120 for releasable connection to the air hose 32*b* and an elbow 122 located behind the back bracket 86*b* whereat the brush motor air tube 116 enters the boom 102. The brush motor air tube subassembly 116 extends within the boom 102 from the elbow 122 to the brush motor 112. The boom 102 includes an exhaust port 113 located generally opposite the elbow 122 for exhausting air from the brush motor 112.

The brush subassembly 110 includes an axially rotatable shaft 124 including a proximate or rear end 126 drivingly, coaxially received in the chuck 114 and a distal or front end 128 coaxially mounting a generally circular brush 129 with a brush hub 130. A plurality of flexible line segments 132 extend radially outwardly from the brush hub 130. The flexible line segments or bristles 132 can comprise a suitable material chosen for its characteristics such as flexibility, diameter (or gauge), etc. The brush hub 130 can be mounted on the brush shaft front end 128 by a brush mounting screw 134.

An air jet subassembly 136 is mounted generally on the brush/air jet boom back end 106 and includes an inlet tee ("T") connector 138 positioned generally within the brush/air jet boom 102 in proximity to its back end 106 and mounting an inlet coupling 140 releasably connected to the air hose 32*c*. The inlet T connector 138 protrudes slightly from laterally-opposed manifold openings 143 in the boom 102 in proximity to its back end 106.

A pair of inboard T connectors 144 are pneumatically connected to the inlet T connector 138 by a pair of manifold extensions 146, each of which extends laterally from a respective side of the brush/air jet boom 102. A pair of outboard T connectors 148 are mounted on the inboard T connectors 144.

The T connectors 138, 144, 148 and the manifold extensions 146 generally form an air jet manifold 150 which extends generally transversely with respect to the brush/air jet boom 102 and receives pressurized air through the inlet T connector 138. A pair of inboard air jet means 151 with nozzles 152 are mounted on the inboard T connectors 144 and are directed generally rearwardly from the vehicle 12. Each inboard nozzle 152 includes swivel or pivotal mounting means for movement between raised and lowered positions (FIG. 6), e.g., by rotatably mounting the inboard T connectors 144 for movement about a horizontal pivotal axis extending generally transversely with respect to the brush/air jet boom 102.

A pair of outboard nozzle means 154 are mounted on the outboard T connectors 148. Each outboard nozzle means 154 includes upper and lower outboard nozzles 156*a*. 156*b* which are rotatably mounted on a respective outboard T connector 148 for rotation about a generally vertical pivotal axis.

The overall width of the air jet subassembly 136 can be varied by substituting manifold extension sections 146 of different lengths to thereby alter the spacing of the nozzle means 151, 154 from the brush/air jet boom 102.

IV. Spray Boom Assembly 16

The spray boom assembly 16 is adapted for mounting on the vehicle 12 in lieu of the brush/air jet boom assembly 14 and generally comprises a spray boom 158 with front and back ends 160, 162. The spray boom back end 162 is open and the spray boom 158 includes a pair of spray boom hose openings 164 located between the front mounting bracket 86*a* and the boom front end 160.

A spray head subassembly 166 is mounted on the spray boom front end 160 and includes a coaxial spray nozzle 168 which, in the illustrated embodiment, is adapted for providing a generally circular 360° spray pattern of spray material 170. Other types of spray nozzles with different spray patterns could be employed with the cleaning system 10 of the present invention. The spray material 170 is pumped to the spray head assembly 166 from the liquid spray material source 34 by way of the liquid spray material hose 36 which enters the spray boom 158 through its open back end 162, exits the spray boom 158 through a boom hose opening 164, and is fluidically connected to the spray head subassembly 166 by a spray material elbow 176. In the spray head subassembly 166, the spray material 170 is mixed with an air flow, e.g., from the air source 30. Pressurized air is communicated with the spray head subassembly 166 by means of the air hose 32b or 32c, which enters the spray boom 158 through its open back end 162, exits the spray boom 158 through a respective boom hose opening 164, and pneumatically communicates with the spray head subassembly 166 by means of an air elbow 178.

The spray boom assembly 16 can be removed and installed on the vehicle 12 by opening and closing the mounting brackets 86a, 86b and is secured in the mounting bracket openings 96a, 96b by annular boom mounting gaskets 108.

V. Duct Cleaning Method

Without limitation on the generality of useful applications of the cleaning system 10, it is shown and described in connection with a method for cleaning the duct passage inner surfaces 18. The method can include the step of accessing the duct passage 20, which can generally be accomplished by removing a section of duct or by removing a grill or vent to uncover an opening thereinto.

The system 10 is normally operated in a "dry" mode of operation first with the brush/air jet boom assembly 14 mounted on the vehicle 12 and the air hoses 32a, 32b, 32c of suitable lengths connected to the couplings 66, 72, 120 respectively and to the air source 30. The air hoses 32a, 32b, 32c and the respective couplings 66, 72, and 120 can be correspondingly color-coded to facilitate proper coupling therebetween. Alternatively, different sizes and/or configurations of couplings can be utilized whereby the air source 30 and the vehicle 12 can only be pneumatically coupled one way. Air source 30 operating pressure in a range of about 150 to 200 p.s.i. can operate the system 10. Various combinations of nozzles 152, 156a, 156b with different sizes and configurations can be used to configure the air jet manifold 150 for a desired pneumatic output.

During an insertion pass of the vehicle 12, the drive subsystem 60 and the brush subassembly 110 are preferably actuated by compressed air from the air source 30 by means of the air hoses 32a, 32b. The vehicle 12 is thus propelled forward by its rear wheel assembly 50 simultaneously with the rotating operation of the brush subassembly 110. On the entry or insertion pass the brush line segments or bristles 32 function to dislodge accumulated dust and other debris on the passage inner surfaces 18. Since duct work is commonly fabricated with relatively thin-gauge sheet metal, the rapid and repeated succession of blows from the brush bristles 32 segments 132 tends to vibrate the duct walls 24, 26 and 28, thereby loosening the dust and debris accumulations thereon and facilitating a thorough cleaning of the duct passage 20. Since the brush 129 is mounted in front of the vehicle front end 38, its cleaning action will reach to about the maximum penetration of the vehicle 12. When the maximum travel distance is reached, whether limited by the end of a duct run being encountered or the air hoses 32a, 32b, 32c, being stretched to their maximum lengths, the air power to the vehicle drive motor 78 and the brush motor 112 is interrupted, and the air jet subassembly 136 is pneumatically actuated by introducing compressed air into the manifold 150 by means of the air hose 32c. The vehicle 12 can be retrieved by pulling on the air hoses 32a, 32b, 32c, with the air nozzles 52, 56a, 56b pneumatically sweeping and pushing the loosened dirt and debris ahead of the vehicle 12 towards the duct opening, where it can be collected for disposal. Alternatively, the vehicle drive motor 78 can be reversible for self-propulsion on the return or retraction pass.

The brushing/pneumatic sweeping steps with the brush/air jet boom assembly 14 mounted on the vehicle 12 can be repeated as many times as is necessary to achieve thorough cleaning. Under normal conditions, inserting and retrieving the vehicle 12 twice will often suffice.

Dust and debris dislodged by the brush 129 at the very end of the insertion pass and not swept out by the nozzles 152, 156a, 156b (i.e., in an area approximately equal in length to the length of the brush/air jet boom assembly 14) will normally be pneumatically swept clean when the HVAC system is actuated and an air current is introduced into the duct 22. However, such remaining amounts of dirt and debris are normally relatively insignificant. Also, the brush 129 itself provides something of a pneumatic fanning action which can tend to blow loose dirt and debris towards the vehicle rear end 40 for pneumatic sweeping by the air jet subassembly 136 on the retraction stroke.

After the brushing/pneumatic sweeping steps are completed, the duct passage 20 is preferably substantially clean and its inner surfaces 18 substantially free of accumulated dirt and debris.

The duct cleaning method of the present invention next calls for the step or steps of spraying the duct passage inner surfaces 18 with a disinfectant and/or a sealer from the liquid source 34. The vehicle 12 can be reconfigured for use with the spray boom assembly 16 by separating the brackets 86a, 86b by loosening the thumbscrews which secure their respective sections 88a, 88b and 90a, 90b together in clamping engagement, replaces the brush/air jet boom assembly 14 with the spray boom assembly 16 and reassembling the mounting brackets 86a, 86b.

Various types of liquid spray materials can be applied to the duct passage inner surfaces by means of the system and method of the present invention to achieve a desired cleaning and/or treatment result. For example, liquid disinfectant materials can be applied to control microorganic activity, including various bacteria, molds and fungi. Sealing materials can also be applied for sealing the duct inner surfaces to entrap any accumulated dirt or debris which might remain on the passage inner surfaces 18 and thus prevent it from entering the air stream.

Various other materials could be sprayed onto the duct passage inner surfaces 18, e.g., paint, rust inhibitor, primer, anti-bacterial agents, etc.

Operation of the cleaning system 10 is not limited to ducts in general, and in particular it is not limited to ducts with rectangular cross-sectional configurations. For example, FIG. 11 shows the vehicle 12 in operation cleaning an inner surface 180 of a passage 182 in a duct 184 with a round cross-sectional configuration.

The vehicle 12 is adaptable to a variety of cleaning operations. For example, the brush/air jet boom assembly 14 can be reconfigured by:

(1) reorienting the spray nozzles 52, 56a, 56b;
(2) extending the manifold 43 with different lengths of manifold extensions 146;
(3) adding or removing nozzles;
(4) substituting brushes 129 with different diameters and flexible line segment characteristics (e.g., length, stiffness, density, etc.);
(5) flipping over the brush/air jet boom assembly 14 to reorient its inboard nozzle means 52; and (6) utilizing different spray nozzles 168 for different spray patterns.

It is to be understood that while certain forms of the present invention have been illustrated and described herein, it is not to be limited to the specific forms or arrangement of parts described and shown.

What is claimed and desired to be secured by Letters Patent is as follows:

1. A cleaning system vehicle having front and back ends and powered by a pressurized fluid source, said vehicle comprising:

(a) a chassis;

(b) drive means mounted on the chassis for propelling the chassis in a first direction, said drive means including a fluid motor and first fluid connection means for connecting the fluid motor to the pressurized fluid source;

(c) fluid-powered cleaning means mounted on said chassis for cleaning the inner surfaces of a duct passage, said cleaning means including second fluid connection means for connecting the cleaning means to the pressurized fluid source;

(d) said cleaning means further comprising a brush rotatably mounted on the chassis and a cleaning system fluid motor drivingly connected to the brush;

(e) said brush being mounted in proximity to said vehicle front end;

(f) said first and second fluid connection means being located in proximity to said vehicle back end; and (g) said cleaning means further including a boom with front and back ends, said brush being mounted on the boom front end coaxially with the booms, air jet means mounted on the boom back end for sweeping the inner surfaces of a duct passage, and a boom mounting bracket connected to the chassis and to the boom.

2. The vehicle of claim 1 wherein the drive means includes:

(a) said fluid motor comprising an air motor; and (b) a pair of drive wheels drivingly connected to the air motor.

3. The vehicle of claim 2, which includes:

(a) a pair of guide wheels mounted on the chassis.

4. The vehicle of claim 2 wherein said drive means includes:

(a) a drive shaft drivingly connected to said air motor;

(b) a pair of axles each drivingly connected to a respective drive wheel; and (c) gearbox means mounted on the chassis and drivingly interconnecting the drive shaft and the axles.

5. The vehicle of claim 1 wherein:

(a) said fluid motor is reversible.

6. The vehicle of claim 1 wherein said cleaning system includes:

(a) fluid jet means for directing a flow of fluid from said vehicle;

(b) said fluid jet means being mounted on said chassis; and (c) third fluid connection means for connecting the fluid jet means to the pressurized fluid source.

7. The vehicle of claim 6, which includes:

(a) a transverse manifold pneumatically connected to said third fluid connection means and including opposite ends; and (b) said fluid jet means comprising a pair of outboard nozzle means each located at a respective manifold end and a pair of inboard nozzle means each located inboard from a respective outboard nozzle means.

8. The vehicle of claim 7, which includes:

(a) an inboard nozzle pivotal axis extending transversely with respect to said vehicle, each said inboard nozzle means being pivotable with respect to said inboard nozzle pivotal axis.

9. The vehicle of claim 8, wherein:

(a) each said outboard nozzle means includes upper and lower nozzles and a respective generally vertical outboard nozzle pivotal axis; and (b) each said outboard nozzle is independently pivotal with respect to a respective outboard nozzle pivotable axis.

10. The vehicle of claim 1 wherein:

(a) said boom mounting bracket includes detachable mounting means for detachably mounting said boom on said chassis.

* * * * *